United States Patent [19]

Aotsuka

[11] Patent Number: 4,960,681

[45] Date of Patent: Oct. 2, 1990

[54] PROCESS FOR FORMING AN IMAGE

[75] Inventor: Yasuo Aotsuka, Kanagawa, Japan

[73] Assignee: Fuji Photo Film Co., Ltd., Kanagawa, Japan

[21] Appl. No.: 492,374

[22] Filed: Mar. 9, 1990

Related U.S. Application Data

[63] Continuation of Ser. No. 919,115, Feb. 15, 1986, abandoned.

[30] Foreign Application Priority Data

Oct. 18, 1985 [JP] Japan ..... 60-232965
Apr. 18, 1986 [JP] Japan ..... 61-89513

[51] Int. Cl.[5] ..... G03C 8/32; G03C 1/494

[52] U.S. Cl. ..... 430/351; 430/203; 430/617; 430/627; 430/634

[58] Field of Search ..... 430/351, 203, 617, 627, 430/634

[56] References Cited

U.S. PATENT DOCUMENTS

| | | | |
|---|---|---|---|
| 3,795,640 | 3/1974 | Pande et al. | 430/627 |
| 3,811,889 | 5/1974 | Endou et al. | 430/634 |
| 4,087,282 | 5/1978 | Mitsui et al. | 430/627 |
| 4,618,575 | 10/1986 | Maekawa et al. | 430/634 |
| 4,656,124 | 4/1987 | Komamura | 430/203 |

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A process for forming an image comprising heating a heat-developable light-sensitive material comprising a support having thereon at least a light-sensitive silver halide and a high molecular weight compound containing a repeating unit derived from a vinyl monomer having at least one of a group -COOM and a group $-SO_3M$ wherein M represents a hydrogen atom or an alkali metal atom, simultaneously with or after image-wise exposure thereof in the presence of water and at least one of a base and a base precursor.

16 Claims, No Drawings

PROCESS FOR FORMING AN IMAGE

This is a continuation of Application No. 06/919,115 filed Oct. 15, 1986, now abandoned.

FIELD OF THE INVENTION

The present invention relates to a process for forming an image by heating.

BACKGROUND OF THE INVENTION

Heat developable light-sensitive materials are known in the photothermographic art. Examples of such heat developable light-sensitive materials and corresponding processes for image formation therein are described in *SHASHIN KOGAKU NO KISO* (Fundamentals of Photographic Engineering) (published in 1979 by Corona, pp. 553–555), *EIZO JOHO* (Image Information) (April 1978, page 40), *Handbook of Photography and Reprography* (edited by Nebletts, 7th Ed., published by Van Nostrand Reinhold Company, pp. 32–33), U.S. Pat. Nos. 3,152,904, 3,301,678, 3,392,020, and 3,457,075, British Patent Nos. 1,131,108 and 1,167,777, and *Research Disclosure,* No. 17029 (June 1978, pp. 9 to 15).

Many photothermographic processes have been proposed to obtain a color image. Processes for forming a color image by combining an oxide form of a developing agent with a coupler have been proposed. Examples of such a combination of an oxide form of a developing agent and a coupler include the combination of a p-phenylene diamine reducing agent and a phenolic or active methylene coupler, as described in U.S. Pat. No. 3,531,236; a p-aminophenolic reducing agent as described in U.S. Pat. No. 3,761,270; sulfoneamide phenolic reducing agent as described in Belgian Patent No. 802,519 and *Research Disclosure,* September 1975, pp. 31 to 32; a combination of a sulfoneamide phenolic reducing agent and a four-equivalent coupler, as described in U.S. Pat. No. 4,021,240.

However, these processes are disadvantageous in that since an image of reduced silver and a color image are simultaneously formed in the exposed portion after heat development, the color image becomes turbid.

In order to solve this problem, the silver image may be removed by liquid processing, or a dye alone may be transferred to another layer such as a sheet having an image receiving layer. However, this process is also disadvantageous in that it is very difficult to distinguish between the unreacted matter and the dye and then transfer the dye alone.

These process are further disadvantageous in that development takes a comparatively long period of time, and the resulting image has a high degree of fog and a low color density.

In order to eliminate these defects, an image formation process has been developed utilizing a silver halide in which a mobile dye is formed imagewise and then transferred to a dye fixing layer, as described in Japan Patent Application (OPI) Nos. 149046/83, 154445/84, 165054/84, and 180548/84 (the term "OPI" as used herein means an "unexamined published application"), and U.S. Pat. Nos. 4,503,137, 4,474,867, 4,483,914, and 4,455,363.

Among these types of image formation processes is a process which comprises heating a heat-developable light-sensitive material in the presence of water and a base and/or base precursor. In such a process, heating is normally conducted supplying water to the light-sensitive material.

However, if the light-sensitive material does not absorb water uniformly and rapidly, uneven development takes place, or the total processing time is undesirably the water supplied to the light-sensitive element is distributed to the dye fixing element in a large amount during heat development or dye transfer, the drying time of the dye fixing material becomes longer.

SUMMARY OF THE INVENTION

It is therefore an object of the present invention to provide a process for forming an image which can easily provide an image having a sufficient density in a short processing time without resulting in an uneven development.

The above and other objects of the present invention attained by a process for forming an image comprising heating a heat-developable light-sensitive material comprising a support having thereon at least a light-sensitive silver halide and a high molecular weight compound containing a repeating unit derived from a vinyl monomer having at least one of a group —COOM and a group —$SO_3M$ wherein M represents a hydrogen atom or an alkali metal atom, simultaneously with or after imagewise exposure thereof in the presence of water and at least one of a base and a base precursor (expressed shortly "a base and/or base precursor" hereinafter).

DETAILED DESCRIPTION OF THE INVENTION

By using the above high molecular weight compound, the heat-developable light-sensitive material of the present invention can absorb a large amount of water uniformly in a short time, thus the development can be achieved to form an image having a sufficiently high density without unevenness. Furthermore, in the dye transfer system, it is prevented that the water supplied to the light-sensitive element is distributed to the dye fixing element in a large amount during heat development or dye transfer, thus the dye fixing element can be dried easily.

In the present invention, a high molecular weight compound is used. This high molecular weight compound is a homopolymer of a monomer having at least one of a group —COOM and a group —$SO_3M$ wherein represents a hydrogen atom or an alkali metal atom, a copolymer of two or more kinds of the above monomers, or a copolymer of the above monomer(s) and other monomer(s).

As the high molecular weight compound of the present invention, a homopolymer or a copolymer containing a repeating unit represented by formula (I) is preferable.

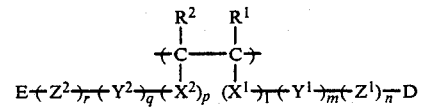

(I)

wherein $R^1$ represents a hydrogen atom, a substituted or unsubstituted alkyl group having from 1 to 6 carbon atoms, a chlorine atom, or a group —COOM wherein M represents a hydrogen atom or an alkali metal atom, $R^2$ represents a hydrogen atom, a substituted or unsubstituted alkyl group having from 1 to 6 carbon atoms, or a chlorine atom; $X^1$ and $X^2$ each represent a group $$-\underset{\underset{O}{\|}}{C}-O-,$$

a group $$-\underset{\underset{O}{\|}}{C}-\underset{\underset{R^3}{|}}{N}-$$

(wherein $R^3$ represents a hydrogen atom, a substituted or unsubstituted alkyl group, or a substituted or unsubstituted aryl group), or a substituted or unsubstituted phenylene group; $Y^1$, $Y^2$, $Z^1$ and $Z^2$ each represent a linking group having a valence of 2, preferably represent a substituted or unsubstituted alkylene group, a substituted or unsubstituted aralkylene group, a substituted or unsubstituted phenylene group, $-R^4COO-$, $-R^5OCO-$, $-R^6OCOR^7-COO-$, $$-R^8-\overset{\overset{R^9}{|}}{N}-,$$

or $-R^{10}-O-$, wherein $R^4$, $R^5$, $R^6$, $R^7$, $R^8$, $R^9$ and $R^{10}$ each represent a substituted or unsubstituted alkylene group, a substituted or unsubstituted phenylene group, or a substituted or unsubstituted aralkylene group; D represents $-(R^{11})_aCOOM$ or $-(R^{11})_bSO_3M$; E represents a hydrogen atom, $-(R^{11})_aCOOM$ or $-(R^{11})_bSO_3M$ (wherein M represents a hydrogen atom or an alkali metal atom, $R^{11}$ represents a substituted or unsubstituted alkylene group, a substituted or unsubstituted phenylene group, or a substituted or unsubstituted aralkylene group, and a and b each represent 0 or 1); 1, m, p and q each represent 0 or 1; and n and r each represent an integer of from 0 to 30.

Examples of the substituent for $R^3$, $R^4$, $R^5$, $R^6$, $R^7$, $R^8$, $R^9$, $R^{10}$ and $R^{11}$ include an aryl group (such as a phenyl group), a nitro group, a hydroxy group, a cyano group, a sulfo group, an alkoxy group (such as a methoxy group), an aryloxy group (such as a phenoxy group), an acyloxy group (such as an acetoxy group), an acylamino group (such as an acetylamino group), a sulfonamide group (such as a methanesulfonamide group), a sufamoil group (such as a methylsulfamoyl group), a halogen atom, a carboxy group, a carbamoyl group (such as a methylcarbamoyl group), an alkoxycarbonyl group (such as a metoxycarbonyl group), a sufonyl group (such as methanesulfonyl group), and the like. When two or more substituents exist, they may be the same or different.

As the high molecular weight compound of the present invention, a homopolymer or a copolymer containing a repeating unit represented by formula (II) or formula (III) is more preferable.

$$\left(CH_2\overset{\overset{R^1}{|}}{\underset{\underset{(X^1)_l(R^{11})_a COOM}{|}}{C}}\right) \quad \text{(II)}$$

-continued $$\left(CH_2\overset{\overset{R^1}{|}}{\underset{\underset{(X^1)_l(R^{11})_a SO_3M}{|}}{C}}\right) \quad \text{(III)}$$

wherein $R^1$, $X^1$m $R^{11}$, M, 1 and a each represent the same meanings as in formula (I).

In the present invention, the high molecular weight compound may be a homopolymer of the above repeating unit, a copolymer of two or more of the above repeating units, or a copolymer of the above repeating unit(s) and other repeating unit(s).

Examples of the monomer which forms the high molecular weight compound of the present invention other than the monomer to be derived to the above repeating unit include an acrylic acid ester, a methacrylic acid ester, a crotonic acid ester, a vinyl ester, a maleic acid diester, a fumaric acid diester, an itaconic acid diester, acrylamides, methacrylamides, vinylethers, styrenes, unsaturated nitriles, and the like.

A sasponified product of the copolymer containing the above monomers can be used as the high molecular weight compound of the present invention.

Specific examples of the monomer other than the monomer to be derived to the above repeating unit are described below.

Examples of the acrylic acid ester include methylacrylate, ethylacrylate, n-propylacrylate, isopropylacrylate, n-butylacrylate, isobutylacrylate, tertbutylacrylate, hexylacrylate, 2-ethylhexylacrylate, acetoxyethylacrylate, phenylacrylate, 2-methoxyacrylate, 2-ethoxyacrylate, 2-(2-methoxyethoxy)ethylacrylate, etc. Examples of the methacrylic acid ester include methylmethacrylate, ethylmethacrylate, n-propylemethacrylate, n-butylmethacrylate, tert-butylmethacrylate, cyclohexylmethacrylate, 2-hydroxyethylmethacrylate, 2-ethoxyethylmethacrylate, etc. Examples of the crotonic acid ester include butylcrotonate, hexylcrotonate, etc. Examples of the vinyl ester include vinylacetate, vinylpropionate, vinylbutylate, vinylmethoxyacetate, vinylbenzoate, etc. Examples of the maleic acid diester include diethylmaleate, dimethylmaleate, dibutylmaleate, etc. Examples of the fumaric acid diester include diethylfumalate, dimethylfumalate, dibutylfumalate, etc. Examples of the itaconic acid diester diethylitaconate, dimethylitaconate, dibutylitaconate, etc. Examples of the acrylamides include acrylamide, methylacrylamide, ethylacrylamide, propylacrylamide, n-butylacrylamide, tert-butylacrylamide, cyclohexylacrylamide, 2-methoxyethylacrylamide, dimethylacrylamide, diethylacrylamide, phenylacrylamide, etc. Examples of the methacrylamide include methylmethacrylamide, ethylmethacrylamide n-butylmethacrylamide, tert-butylmethacrylamide, 2-methoxymethacrylamide, dimethylmethacrylamide, dietnylmethacrylamide, etc. Examples of the vinylethers include methylvinylether, buthylvinylether, hexylvinylether, methoxyethylvinylether, dimethylaminoethylvinylether, etc. Examples of the styrenes include styrene, methylstyrene, ethylstyrene, isopropylstyrene, butylstyrene, chloromethylstyrene, methoxystyrene, butoxystyrene, acetoxystyrene, chlorostyrene, dichlorostyrene, bromostyrne, vinylbenzoic acid methylester, 2-methylstyrene, etc. Examples of the unsaturated nitriles include acrylonitrile, methacrylonitrile, α-ethylacrylonitrile, α-methoxyacrylonitrile, etc.

Preferred examples of the high molecular weight compound of the present invention include the saponified product of a copolymer consisting of at least vinyl ester and an ethylenic unsaturated caboxylic acid or its derivative as described in Japanese Patent Application (OPI) Nos. 14689/77, 50290/78, 160387/76, 65597/78, 82666/78, 104652/78, 104691/78, and 105589/78, and Japanese Patent Publication Nos. 13495/78 and 13678/78, and the hydrolyzate of an acrylonitrile polymer as described in Japanese Patent Application (OPI) Nos. 80493/78, 60985/78, and 63486/78.

Examples of the above-mentioned vinyl ester include vinyl acetate, vinyl propionate, and vinyl stearate. Preferred among these vinyl esters is vinyl acetate.

Examples of the ethylenic unsaturated carboxylic acid or its derivative include acrylic acid, methacrylic acid, crotonic acid, itaconic acid, maleic acid, fumaric acid, maleic anhydride, itaconic anhydride (and their esters), acrylamide, and methacrylamide. Preferred examples of the ethylenic unsaturated carboxylic acid or its derivative include acrylic acid methacrylic acid (and their corresponding methyl esters, ethyl esters, n-propyl esters, isopropyl esters, n-butyl esters and t-butyl esters), acrylamide, and methacrylamide.

The molar ratio of the vinyl ester component (x) to be ethylenic unsaturated carboxylic acid (y) is about 0:100 to about 80:20, preferably 0:100 to 70:30 and more preferably 0:100 to 60:40.

Other ethylenic components may be contained in the copolymer in an amount of about 1 to about 10 mol %, preferably 3 to 7 mol %.

The saponification degree is preferably about 30 mol % or more of the vinyl ester component in the above copolymer. If the ethylenic unsaturated carboxylic esters are copolymerized, the saponification degree is preferably about 30 mol % or more of the ethylenic unsaturated carboxylic ester component, more preferably 70 mol % or more.

The acrylonitrile polymer is a general term used to describle polymers containing acrylonitrile as a copolymer component. Specific examples of such a polymer include a homopolymer of acrylonitrile, a copolymer of acrylonitrile and one or more different ethylenic unsaturated compounds, and a graft polymer of acrylonitrile and other polymer such as starch and polyvinyl alcohol.

On these polymeric acrylonitrile-containing compounds, the content of acrylonitrile is about 30% or more by wieght, preferably 50% or more by weight.

The above-described hydrolyzates of an acrylonitrile compounds may be a polymer containing acrylates and acrylamides produced by the hydrolysis of the acrylonitrile portion.

The high molecular weight compound of the present invention preferably has an average molecular weight of from $1\times10^4$ to $2\times10^6$. When the high molecular weight compound of the present invention is a copolymer of a monomer having —COOM or —$SO_3M$ and other monomer, the content of the monomer having at least one of —COOM and —$SO_3M$ is preferably in the range of from 1 to 99.5 mol %, more preferably from 20 to 99 mol % based on the total amount of the high molecular weight compound calculated as repeating unit.

Specific examples of the high molecular weight compound of the present invention are mentioned below. The copolymerization ratio is based on mole.

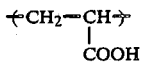
(1)

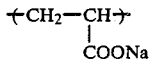
(2)

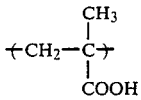
(3)

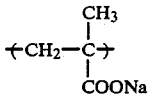
(4)

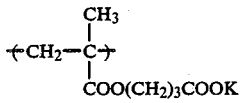
(5)

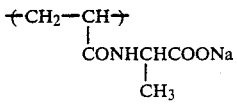
(6)

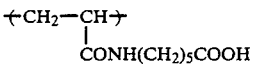
(7)

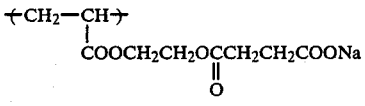
(8)

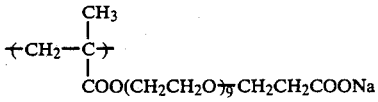
(9)

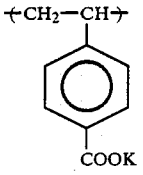
(10)

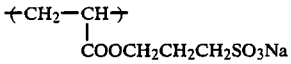
(11)

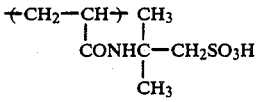
(12)

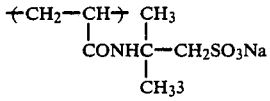
(13)

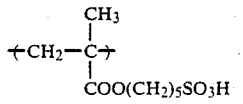
(14)

-continued (15)

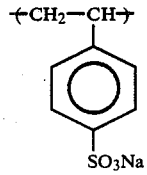

(16)

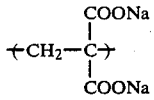

(17)

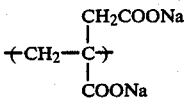

(18)

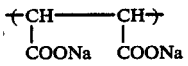

(19)

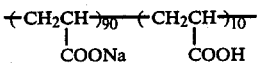

(20)

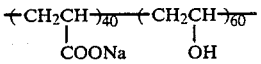

(21)

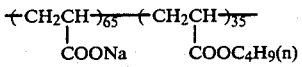

(22)

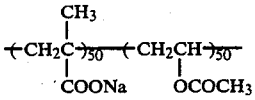

(23)

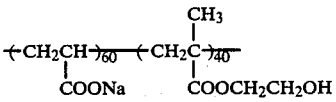

(24)

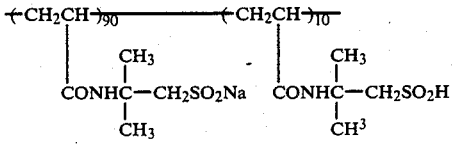

(25)

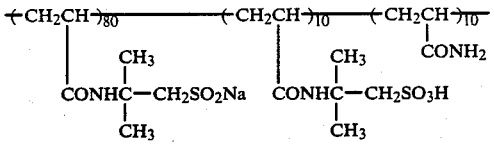

(26)

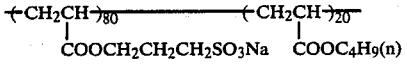

(27)

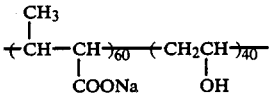

(28)

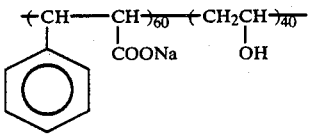

-continued (29)

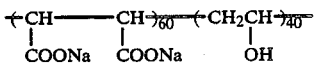

(30)

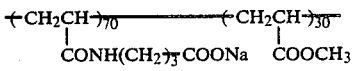

(31)

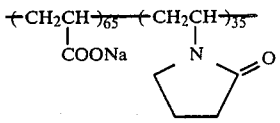

In addition to the above, specific examples of the above-described saponified product of a copolymer include the saponified product of a copolymer of vinyl acetate (containing about 62 mol % of methyl acrylate) and methyl acrylate (saponification degree: about 90 mol %), the saponified product of a copolymer of vinyl acetate (containing about 20 mol % of methyl acrylate) and methyl acrylate (saponification degree: about 98 mol %), and the saponifide product of a copolymer of vinyl acetate (containing about 48 mol % of methyl acrylate) and methyl acrylate (saponification degree: about 98.3 mol %). Examples of such a product which is commercially available include SUMIKAGEL L-5 produced by Sumitomo Chemical Co., Ltd.

Specific examples of hydrolyzate of acrylonitrile compounds include the hydrolyzate of a copolymer of acrylonitrile containing 90 wt% of acrylonitrile with methyl acrylate, the hydrolyzate of a graft copolymer of starch and acrylonitrile, and the hydrolyzate of a copolymer comprising acrylonitrile (85 mol %), methyl acrylate (6.2 mol %) and vinylidene chloride (8.8 mol %).

The above-mentioned high molecular weight compounds of the present invention can absorb a large amount of water in a short time because they have a high degree of swelling with respect to water in a from of a coated layer. The high molecular weight compound of the present invention preferably has a degree of swelling of 5 or more, more preferably 10 or more with respect to water.

The term "degree of swelling" as used herein means the value of the ratio of the thickness of the layer swollen to the thickness of the dried layer obtained by measuring the amount of swelling of a water-insoluble coated layer comprising a high molecular weight compound (e.g., gelation or the high molecular weight compound of the present invention) by water at room temperature. The coated layer optionally has been rendered water-insoluble by a crosslinking agent and/or by curing. The measurement of swelling is accomplished by the process described in Photographic Science Engineering (Vol. 16, page 449, 1972).

In the present invention, a layer of the high molecular weight compound of the present invention or a layer comprising the high molecular weight compound of the present invention dispersed in hydrophilic colloid binder such as gelatin is provided on a support. Since such a layer has the capability of rapidly absorbing and being swollen by water for dye transfer, the use of this type of layer allows various processing steps, such as development and dye transfer, to proceed smoothly and be finished in a short period of time. The same holds true even if the layer has been hardened by a crosslinking agent and/or by curing to impart sufficient mechanical strength to the layer. Furthermore, such a layer does not cause reticulation while being dried after the processing.

These high molecular weight compounds of the present invention may be used either singly or in combination with other hydrophilic colloids, such as gelation, to form a coated layer.

Further, if these high molecular weight compounds are used singly to form a coated layer, a crosslinking agent may also be used. Alteratively, instead of using such a crosslinking agent, curing is preferably effected after coating. Additioinally, the crosslinking agent may be present during curing, if desired. Examples of the crosslinking agent include aldehydes such as glutaraldehyde, glyoxal, and adipaldehyde, epoxy compounds such as epichlorohydrin, ethyleneglycol glycidylether, polyethyleneglycol glycidylether, glycerin diglycidylether, trimethylol propane triglycidylether, and 1,6-hexanediol diglycidylether, bishalogenated compounds such as dichlorohydrin and dibromohydrin, and isocyanate compounds such as 2,4-trilenediisocyanate and hexamethylenediisocyanate. Epoxy compounds are preferred.

The amount of the crosslinking agent to be used is generally about 0.005 to about 20 wt %, preferably 0.01 to 10 wt %, based on the weight of the high molecular weight compound.

Curing conditions are optional, but in general, curing is preferably effected at a temperature of from about 40° C. to about 180° C. for from about 30 seconds to about 2 hoiurs, preferably from 50° C. to 120° C. for from 30 seconds to 30 minutes. It is obvious that the higher the curing temperature is, the shorter is the time required for curing.

If the high molecular weight compound of the present inventioin is used in combination with other crosslinked hydrophilic colloids such as gelatin to form a coated layer, the addition of a crosslinking agent for the high molecular weight compound and the curing ste may be omitted.

In the present invention, the high molecular weight compound is preferably used in a coated amount of from about 0.05 to about 20 g/m$^2$, more preferably from 0.1 to 5 g/m$^2$.

The heat-developable light-sensitive material of the present invention may comprise a dye fixing element, in addition to the light-sensitive element.

Water may be supplied to the heat-developable, light-sensitive material by any suitable process. For example, water may be sprayed through a nozzle or may be applied via a wet roller to the material. Water may also be supplied by a process in which a pod containing water is pressed. The present invention, however, is not restricted to these specific processes. Alternatively, water may be incorporated in the material as water of crystallization or via microcapsules.

If water is externally supplied, such is preferably supplied directly to the ligh-sensitive element. On the other hand, if a dye fixing element is used, water may have been previously supplied to the dye fixing element. The dye fixing element is then superimposed on the light-sensitive element so that the light-sensitive element is allowed to absorb water.

The water used in the present invention is not limited to pure or distilled water, but includes water commonly used in this field of art. Alternatively, water may be supplied in the form of an aqueous solutioin containing a base and/or base precursor as described hereinafter or a solvent mixed with a low boiling point solvent such as methanol, DMF, acetone, and diisoibutyl ketone. Furthermore, water may be used in the form of an aqueous solution containing an image formation accelerator or hydrophilic heat solvent as described, for example, in Japanese Patent Application (OPI) No. 147244/86. A surface active agent may further be contained in water contemplated for use herein. The surface active agent allows for uniform feeding cf water to the light-sensitive element or the dye fixing element.

The amount of water to be used in the present invention is generally at least about 0.1 times the total weight of the entire coated layer of the light-sensitive element and the dye fixing element, preferablly between 0.1 times the total weight of the entire coated layer and the weight of water corresponding to the maximum swelling volume of the entire coated layer, and more preferably between 0.1 times the total weight of the entire coated layer and the weight of water corresponding to the maximum swelling volume of the entire coated layer less the weight of the entire coated layer.

The layer itself is normally unstable when swollen. Moreover, some conditions may cause localized stains. In order to eliminate these problems, the amount of water to be used is preferably less than the weight of water which woiuld correspond to the maximum swelling volume of the entire coated layer of the light-sensitive element and the dye fixing element, as described above.

However, even if water is used in an amount in excess of the above range, only the above defect arises, and the desired effect of water is still seen in the same manner as when used in the desired amount.

The base and/or base precursor to be used in the present invention may be incorporated in the light-sensitive element or the dye fixing element, if desired. Alternatively, the base and/or base precursor may be incorporated in a solution of the water used in the present invention, as noted above.

Examples of the base within the scope of the present invention include inorganic bases such as hydroxides, secondary or tertiary phophates, borates, carbonates, quinolinates, and metaborates of alkali metals and alkaline earth metals; ammonium hydroixide; hydroxide of quarternary alkalammonium; and hydroxides of other metals; as well as organic bases such as aliphatic amines (e.g., trialkylamines, hydroxylamines, and aliphatic polyamines); aromatic amines (e.g., N-alkyl-substituted aromatic amines, N-hydroxylalkyl-substituted aromatic amines, and bis(p-(dialkylamino)phenyl)methanes); heterocyclic amines; amidines; cyclic amidines; quanidines; and cyclic guanidines. Bases having a pKa of 8 or more are preferred.

Alternatively, salts of the above-described based with weak bases may also be preferably used. Examples of such salts include carbonates, bicarbonates, borates, secondary and tertiary phosphates, quinolinates, acetates, and metaborates. Besides the above compounds, the compounds described in Japanese Patent Application (OPI) No. 218443/84 may also be preferably used.

Preferred examples of the above-mentioned base precursor include a compound which reacts upon heating to produce or release a base, or another compound capable of producing or releasing a base upon electrolysis or the like. The former type of base precursor includes salts of an organic acid with a base which undergo decarbonation and decomposition upon heating, and compounds which decompose upon certain reactions such as an intramolecular nucleophilic substitution reaction, a Lossen rearrangement, and a Beckmann rearrangement to release an amine upon heating. Preferred examples of the former type of the base precursor capable of producing or releasing a base upon heating include salts of trichloroacetic acid, as described in British Patent No. 998,949, salts of α-sulfonyl acetic acid, as described in U.S. Pat. No. 4,060,420, salts of propiolic acid, as described in Japanese Patent Application (OPI) No. 180537/84, 2-carboxycarboxamide derivatives as described in U.S. Pat. No 4,088,496, salts, of a heat-composable acid with a base (in addition to an organic base), such as alkali metals and alkaline earth metals as described in Japanese Patent Application (OPI) No. 195237/84, hydroxam carbamates which releases a base upon a Lossen rearrangement as described in Japanese Patent Application (OPI) No. 168440/84, and aldoxim carbamates which produces nitrile upon heating as described in Japanese Patent Application (OPI) No. 157637/84. Besides the above compounds, base precursors as described in British Patent No. 998,945, U.S. Pat. No. 3,220,864, Japanese Patent Application (OPI) No. 22625/75, British Patent No. 2,079,480, etc. are also useful.

Examples of compounds capable of producing or releasing a base upon elecrolysis include the following compounds produced in accordance with the described electrolysis methods. For instance, a typical example of a process using electrolytic oxidation is electrolysis of various aliphatic acid salts. By using this type of reaction, carbonates of alkali metals or organic bases such as guanidines and amidines can be extremely efficiently obtained.

Examples of a process using electrolytic reduction include production of amines by reducing nitro and nitroso compounds, production of amines by reducing nitrile compounds, and production of p-aminophenol, p-phenylenediamine, and hydrazine compouonds by reduction of nitro, azo, and azoxy compounds. p-Aminophenol, p-phenylenediamine and hydrazine compounds can be used not only as a base in accordance with the present invention, but also as a color image-forming substance directly.

A process which comprises production of an alkaline component by electrolysis of water in the presence of various inorganic salts may also be utilized.

Besides the above-described processes, there are other processes for producting a base. Any of the compounds used in these processes is useful as a base precursor. Specific examples thereof include a process of producing a base by mixing a slightly soluble metal compound with a compound capable of complexing with metal ions forming a slightly soluble metal compound (referred to as "complexing compound").

This process is more effective and thus preferred. Examples of slightly soluble metal compounds include the carbonates, hydroxides, and oxides of zinc, aluminum, calcium, and barium. Examples of these complexing compounds are described in detail in *Critical Stability Contstants* (edited by A. E. Martell and R. M. Smith, Vol. 4 and Vol. 5, published by Plenum Press). Specific examples of such a complexing compounds also include salts of aminocarboxylic acids, imidinoacetic acids, pyridylcarboxylic acids, aminophosphoric acids, carboxylic acids (e.g., monocarboxylic acid, dicarboxylic acid, tricarboxylic acid, tetracarboxylic acid, and compounds containing substituent: such as a phosphono group, a hydroxy group, an oxo group, an ester group, an amide group, an alkoxy group, a mercapto group, an alkylthio group and a phosphino group), hydroxam acids, polyacrylates, and polyphosphoric acids with alkli metals, guanidines, amidines, and quarternary ammmonium salts.

It is preferred that the slightly soluble metal compound and the compolexing compound are separately added to the light-sensitive element and the dye fixing element, respectively.

The above described bases and/or base precursors may be used singly or in combination.

The base and/or base precursor according to the present invention may be used in a wide range of amounts. If the base and/or base precursor is incorporated in the light-sensitive layer and/or the dye fixing layer, its preferable amount to be used is about 50 wt % or less, preferably 0.01 to 40 wt % based on the weight of each coated layer. If the base and/or base precursor is dissolved in the water suppleid in accordance with the present invention, its concentration is preferably about 0.005 to about 2 mol/1, more preferably 0.05 to 1 mol/1. These amounts and concentrations are not directly related to pH because if the element containing the base and/or base precursor is superimposed on other elements, a base and other compounds migrates to other layers.

In the present invention, a heating step is performed. Since the light-sensitive material containes a relatively large amount of water the highest allowable temperature that the ligh-sensitive material may be heated to is determined by the boiling point of the aqueous solution therein (comprising a solution of various additives in the water used). The lowest heating temperature is about 50° C. or above. Since the boiling point of water at atmospheric pressure is 100° C. and heating up to 100° C. or above results in evaporation of water causing loss of the overall water content, it is preferred that the light-sentisitve material is covered by a water-impermeable material, or the material is heated with high temperature and high pressure water vapor. In these cases, it is advantageous in that the boiling point of the aqueous solution in the light-sensitive material can be increased, and the highest allowable temperature to which the light-sensitive material can be heated, will be correspondingly increased too.

A heating plate, a heating iron, a heating roller, or a heating plate using carbon or titanium white, or analogues thereof can be employed as the specific means for heating.

Silver halides contemplated for usage herein include silver chloride, silver bromide, silver iodide, silver chlorobromide, silver chloroiodide, silver iodobromide, or silver chloroiodobromide.

Specific examples of the silver halides which may be used in the present invention are described in U.S. patent application No. 793,055 (filed on Oct. 30, 1985), U.S. Pat. No. 4,500,626, and Research Disclosure (June 1978, pp. 9–10)

The silver halide emulsion may be unripened; however, the silver halide emulsion is generally subjected to chemical sensitization before use. Either one or combination of the following known sensitization processes, such as a sulfur sensitization process, a reduction sensitization process, and a noble metal sensitization process, can be applied to emulsions to be used in the light-sensitive maerial of the present invention. These chemical sensitization processes may be effected in the presence of a nitrogen-containing heterocyclic compound as described, for example, in Japanese Patent Appliation (OPI) Nos. 126526/83 and 215644/83.

Further, the silver halide emulsion may comprise a surface latent image type which allows a latent image to be formed mainly on the surface of the silver halide particles, or an internal latent image type which allows a latent image to be formed inside the silver halide particles. Alternatively, a direct reversal emulsion obtained by combining an internal latent image type emulsion with a nucleating agent may be used.

The coated amount of the light-sensitive silver halide used in the present invention is in the range of from about 1 mg/m$^2$ to about 10 g/m$^2$ calculated in terms of the amount of silver.

In the present invention, an organic metal salt can be used as an oxidizing agent in combination with the light-sensitive silver halide. In this case, it is organic metal salt be kept in close contact with or proximity to each other.

Particularly useful among these organic metal salts is an organic silver salt.

Examples of such an organic compound which may be used to form the above-mentioned organic metal salt oxidizing agent include those described in U.S. patent application No. 793,055 (filed on Oct. 30, 1985) and U.S. Pat. No. 4,500,626. Silver salts of carboxylic acids containing an alkynyl group such as silver phenylpropionate as described in Japanese Patent Application (OPI) No. 113235/85 may also be used.

The organic silver salt is usually present in an amount from about 0.01 to about 10 mole, preferably 0.01 to 1 mole per mole of light-sensitive silver halide. The total amount of the light-sensitive silver halide and the organic silver salt is preferably about 50 mg/m$^2$ to about 10 g/m$^2$ in terms of the amount of silver.

The silver halide used in the present invention may additionally be spectrally sensitized by a methine dye or the like.

These dyes include cyanine dyes, merocyanine dyes, complex cyanine dyes, complex merocyanine dyes, holopolar cyanine dyes, hemicyanine dyes, styryl dyes and hemioxonol dyes.

Specific examples of such a dye include sentitizing dyes as described in Japanese Patent Application (OPI) Nos. 180550/84 and 140335/85, and *Research Disclosure,* No. 17029 (June 1978, pp. 12–13) and heat-decolorable sensitizing dyes as described in Japanese Patent Application (OPI) No. 111239/85.

These dyes may be used singly or in combination. Combinations of these dyes are often used, particularly for the purpose of supersensitization.

Besides the above-mentioned sensitizing dyes, a dye which itself has no spectral sensitization effect or a substance which absorbs substantially no visible light and provides a supersensitization effect may be used. Examples of this type of dye or substance include those described in U.S. Pat. No. 2,933,390, 3,635,721, 3,743,510, 3,615,613, 3,615,641, 3,617,295, 3,635,721, etc.

These sensitizing dyes may be added to the emulsion containing the light-sensitive silver halide during, before, or after chemical ripening of the emulsion. Moreover, these sensitizing dyes may be added before or after the formation of the nucleus of the silver halide particles, as described in U.S. Pat. Nos. 4,183,756 and 4,225,666.

In general, the amount of the sensitizing dye to be added is from about $10^{-8}$ to about $10^{-2}$ mole per mole of the silver halide.

Silver may be used as the image forming substance in the present invention. Alternatively, a compound which produces or releases a mobile dye of a light-sensitive silver halide to silver at an elevated temperature, i.e., a dye providing substance, may be used.

The dye providing substance will be described hereinafter.

One example of the dye providing substance which may be used in the present invention is a coupler capable of reacting with a developing agent. When using such a coupler, an oxide form of a developing agent produced by the reduction-oxidation reaction of a silver salt with the developing agent reacts with the coupler to form a dye. This process is described in many literature references. Specific examples of developing agents and couplers are described in detail in *The Theory of the photographic Process,* (edited by T. H. James, pp. 291–334 and pp. 354–361) and Japanese Patent Application (OPI) Nos. 123533/83, 149046/83, 149047/83, 111148/84, 124339/84, 174835/84, 231539/84 231540/84, 2950/85, 2951/85, 14242/85, 23474/85, and 66249/85.

Another example of the dye providing substance is a dye silver compound obtained by combining an organic silver salt with a dye. Specific examples of this type of dye providing substance are described in *Research Disclosure,* No. 16966 (May 1978, pp. 54–58).

Further examples of the dye providing substance include an azo dye used in the heat-developable silver dye bleaching process. Specific examples of the azo dye and bleaching process using them are described in U.S. Pat. No. 4,235,957 and *Research Disclosure,* No. 14433 (Apr. 1976, pp. 30–32).

A still further example of the dye providing substance is a leuco dye as described in U.S. Pat. Nos. 3,985,565 and 4,022,617.

A still another example of the dye providing substance is a compound which series to imagewise release or diffuse a diffusible dye.

This type of a compound can be represented by formula (LI)

$$(\text{Dye}-\text{X})_{n-Y} \qquad \text{(LI)}$$

wherein Dye represents a dye group or dye precursor which has been temporarily shifted to short wavelength side in absorption spectrum; X represents a mere chemical bond or a linking group; Y represents a group capable of making a difference in the diffusivity of the compound of formula (LI), or releases a Dye and makes a difference in the diffusivity between the Dye thus released and $(\text{Dye}-\text{X})_{n-Y}$ corresponding to or counter-corresponding to a light-sensitive silver salt having an imagewise latent image; and n represents an integer of 1 or 2, and when n is 2, the two (Dye−X) moieties may be the same or different.

Specific examples of the dye providing substance represented by formula (LI) include dye developers obtained by combining a hydroquinone developer and a dye component as described in U.S Pat. Nos. 3,134,764, 3,362,819, 3,597,200, 3,544,545, and 3,482,972. Furthermore, a substance which allows a diffusible dye to be released upon an intramolecular nucleophilic substitution reaction is described in Japanese Patent Application (OPI) No. 63618/76. A substance which allows a diffusible dye to be released upon an intramolecular rearrangement reaction of iso-oxanolone ring is described in Japanese Patent Application (OPI) No. 111628/74. In these processes, a diffusible dye is released or diffused in a portion of the light-sensitive material where development is not conducted, but is not released or diffused in a portion where development is carried out.

Another type of process is also known. More specifically, a dye-releasing compound is converted to an oxide form having no dye releasing capability. The oxide form of the compound is allowed to be present with a reducing agent or its precursor. After development, the compound is reduced by the reducing agent which has been left unoxidized to release a diffusible dye. Specific examples of such a dye providing substance are described in Japanese Patent Application (OPI) Nos. 110827/78, 130927/79, 164342/81, and 35533/78.

On the other hand, a substance which allows a diffusible dye to be released in a portion where development is carried out includes a substance which releases a diffusible dye upon the reaction of a coupler containing a diffusible dye in a coupling off group with an oxide form of a developing agent. Examples of such a substance are described in British Patent No. 1,330,524, Japanese Patent Publication No. 39165/73, and U.S. Pat. No. 3,443,940.

In these processes using a color developing agent, contamination of images by the products of oxidation decomposition of the developing agent often becomes a serious problem. A dye-releasing compound which itself has reducing ability and needs no developing agent has been proposed to solve this problem.

Typical examples of such a compound include dye providing substances as described in U.S. Pat. Nos. 3,928,312, 4,053,312, 4,055,428, 4,336,322, 3,725,062, 3,728,113, 3,443,939, and 4,500,626, and Japanese Patent Application (OPI) Nos. 65839/84 69839/84, 3819/78, 104343/76, 116537/83, and 179840/82, and *Research Disclosure,* No. 17465. Specific examples of dye providing substance which may be preferably used in the present invention include those described in U.S. Pat. No. 4,500,626. Particularly preferred among these compounds are the compounds (1) to (3), (10) to (13), (16) to (19), (28) to (30), (33), (35), (38) to (40), and (42) to (64) described in the patent cited immediately above. Furthermore, the compounds described in Japanese Patent Application (OPI) No. 124941/86 may also be preferably used.

The above dye providing substances and other hydrophobic additives such as image formation accelerators as described hereinafter can be incorporated in the layers of the light-sensitive material of the present invention by any conventional process, e.g., as described in U.S. Pat. No. 2,322,027. In this case, a high boiling point organic solvent as described in Japanese Patent Application (OPI) Nos. 83154/84, 178451/84, 178452/84, 178453/84, 178454/84, 178455/84, and 178457/84 may be optionally used in combination with a low boiling point organic solvent having a boiling point of from about 50° to about 160° C.

The amount of the high boiling point organic solvent used is about 10 g or less, preferably 5 g or less per 1 g of the dye providing substance.

Alternatively, a diffusion process using a polymerized compound as described in Japanese Patent Publication No. 39853/76 and Japanese Patent Application (OPI) No. 59943/76 may be used.

If the compound used is substantially insoluble in water, the compound may be used in a form of finely dispersed in a binder instead of using the above-described incorporation processes. Various surface active agents may be used to disperse a hydrophobic substance in a hydrophilic colloid. Surface active agents contemplated for this purpose include those described as a surface active agent in Japanese Patent Application (OPI) No. 157636/84.

In the present invention it is preferred that a reducing agent is incorporated in the light-sensitive material. Examples of the reducing agent include those commonly known as reducing agents, as well as the previously described dye providing substances having reducing ability. Examples thereof also include a reducing agent precursor which itself has no reducing ability but shows a reducing ability when reacted with a nucleophilic reagent or upon heating in the development process.

Specific examples of reducing agents which may be used in the present invention include those described in U.S. Pat. Nos. 4,500,626 and 4,483,914, and Japanese Patent Application (OPI) Nos. 140335/85, 128438/85, 128436/85, 128439/85, and 128437/85. Besides the above compounds, reducing agent precursors as described in Japanese Patent Application (OPI) Nos. 138736/81 and 40245/82, and U.S. Pat. No. 4,330,617 may also be used.

Combinations of various developing agents as described in U.S. Pat. No. 3,039,869 may further be used in the present invention.

The amount of the reducing agent added is from about 0.01 to about 20 mole, preferably 0.1 to 10 mole, per mole of silver.

Further, the light-sensitive material may comprise an image formation accelerator. The image formation accelerator serves to: (a) accelerate the reduction-oxidation reaction of a silver salt oxidizing agent with a reducing agent, (b) accelerate the reaction such as production or decomposition of a dye or release of a mobile dye from a dye providing substance, and (c) accelerate the transfer of a dye from the light-sensitive layer to the dye fixing layer. From the physicochemical standpoint of view, image formation accelerators are classified into nucleophilic compounds, high boiling point organic solvents (oil), heat solvents, surface active agents, and compounds capable of interacting with silver or silver ions. However, these substances generally have of the above acceleration effects.

These image formation accelerators are described in detail in Japanese Patent Application (OPI) No. 147244/86.

In the present invention, various development stopping agent may be used to provide images of constant quality against fluctuation in the processing temperature and time during development.

The term "development stopping agent" used herein means a compound which rapidly neutralizes or reacts with a base to lower the base concentration in the layer after a proper development period, thereby stopping development, or a compound which interacts with silver and silver salts to inhibit development after a proper development period. Specific examples of such a development stopping agent include acid precursors which release an acid compound upon heating, electrophilic compounds which undergo a substitution reaction with a base present therewith upon heating, and nitrogen-containing heterocylic compounds, mercapto compounds, and their precursors as described in Japanese Patent Application (OPI) Nos. 108837/85, 192939/85, 230133/85, and 230134/85.

Alternatively, compounds which release a mercapto compound upon heating may also be preferably used. Examples of such compounds are described in Japanese Patent Application (OPI) Nos. 147244/86, 124941/86, and 53632/86.

The light-sensitive materials of the present invention may further comprise a compound which serves to stabilize images as well as to activate development.

Specific examples of such a compound which may be preferably used are described in U.S. Pat. No. 4,500,626.

In the present invention, various antifoggant may also be used. Examples thereof include azoles, carboxylic acids and phosphoric acids containing nitrogen atoms, mercapto compounds and the metal salts thereof, as described in Japanese Patent Application (OPI) No. 111636/84, or acetylene compounds.

The light-sensitive material according to the present invention may additionally contain an image toning agent if necessary. Specific examples of effective image toning agents include compounds as described in Japanese Patent Application (OPI) No. 147244/86.

The binders used in the light-sensitive materials of the present invention may be employed singly or in combination. Such binders include hydrophilic binders, e.g., transparent or semi-transparent hydrophilic binders such as proteins (e.g., gelatin and gelatin derivatives), natural substances (e.g., cellulose derivatives, starch and gum arabic), and synthetic polymers (e.g., polyvinyl pyrrolidone, acrylamide polymers and other water-soluble polyvinyl compounds). Other examples of synthetic polymers include a dispersed vinyl compound in the form of a latex which particularly serves to increase the dimensional stability of the light-sensitive material.

The coated amount of the binder is generally approximately 20 $g/m^2$ or less, preferably 10 $g/m^2$ or less more preferably 7 $g/m^2$ or less.

The amount of the high boiling point organic solvent dispersed in the binder together with a hydrophobic compound such as a dye providing substance is about 1 cc or less, preferably 0.5 cc or less, more preferably 0.3 cc or less, based on 1 g of the binder.

The light-sensitive element and the dye fixing element of the present invention may contain an inorganic or organic hardener in the photographic emulsion layer and/or other binder layers.

Specific examples of the hardener are described in Japanese Patent Application (OPI) Nos. 147244/86 and 157636/84. These hardeners may be used singly or in combination.

The support to be used for the light-sensitive element and, if used, the dye fixing element withstands the above-described processing temperature. In genral, supports which may be employed include glass, paper, a polymer film, metal and analogues thereof. Alternatively, those supports described in Japanese Patent Application (OPI) No. 147244/86 may be used.

If the light-sensitive material of the present invention contains a colored dye providing substance it is not necessary that an anti-irradiation substance or anti-halation substance or various dyes are incorporated in the light-sensitive material. However, filter dyes or absorbing substances as described in Japanese Patent Application (OPI) No. 147244/86 may be contained in the light-sensitive material.

In order to obtain a wide range of colors using the three primary colors (yellow, magenta, and cyan), the light-sensitive material used in the present invention is required to have at least three silver halide emulsion layers each having a sensitivity in different spectral wavelength regions.

Typical examples of combinations of these light-sensitive silver halide emulsion layers having sensitivities in different spectral wavelength regions are described in Japanese Patent Application (OPI) No. 180550/84.

The light-sensitive material used in the present invention may optionally comprise two or more emulsion layers each having different sensitivities in the same spectral wavelength region.

The light-sensitive material may further optionally contain various conventionally contained in heat developable light-sensitive materials, or layers other than light-sensitive layers, such as an anti-static layer, an electrically-conductive layer, a protective layer, an intermediate layer, an antihalation layer, a peeling-off layer, and a matting layer. Examples of these various additives include those described in *Research Disclosure*, No. 17029 (June 1978, Vol. 170), such as plasticizers, sharpness improving dyes, anti-halation dyes, sensitizing dyes, matting agents, surface active agents, fluorescent whitening agents, ultraviolet absorbers, sliding agents, oxidation inhibitors, and discoloration inhibitors.

In particular, the protective layer generally comprises an organic or inorganic matting agent to prevent adhesion. Additionally, the protective layer may contain a mordant, an ultraviolet absorber or the like.

The intermediate layer may contain a reducing agent, ultraviolet absorber, or white pigment such as $TiO_2$ to prevent undesired color stains. In order to increase the sensitivity of the light-sensitive material, the white pigment may be contained not only in the intermediate layer, but also in the emulsion layer.

The protective layer and the intermediate layer each may comprise two or more layers.

If the light-sensitive material of the present invention is designed to form a dye image, it comprises a light-sensitive element which forms or releases a dye by heat development and, optionally, a dye fixing element for fixing the dye thus formed or released.

In a system for forming an image by diffusion and transfer of a dye, a light-sensitive element and a dye fixing element are essential. Typical embodiments of such a configuration are generally divided into two types. In one of these two types, the light-sensitive element and the dye fixing element are separately coated onto their respective supports. In the other, the two elements are coated onto the same support.

With regard to the relationship between the light-sensitive element and the dye fixing element, between the light-sensitive element and the support, and between the light-sensitive element and the white reflective element, those described in Japanese Patent Application (OPI) No. 147244/86 and U.S. Pat. No. 4,500,626 may be applied to the present invention.

A typical example of the latter type is a configuration which does not require that the light-sensitive element be peeled off the dye fixing element after the formation of a transferred image. In such a configuration, a light-sensitive layer, a dye fixing layer and a white reflective layer are laminated on a transparent or an opaque support. A preferred example of such a configuration comprises the successive lamination on a transparent support of a light-sensitive layer, a white reflective layer, and a dye fixing layer. Another example comprises the successive lamination on a transparent support of a dye fixing layer, a white reflective layer, and a light-sensitive layer.

Another example of the latter type is a configuration which requires that the light-sensitive element be partially or entirely peeled off the dye fixing element, as described in Japanese Patent Application (OPI) No. 67840/81, Canadian Patent 674,082, and U.S. Pat. No. 3,730,718. In such a configuration, a peeling-off layer is present in a position to allow for proper peeling.

The light-sensitive element or the dye fixing element of the present invention may further comprise an electrically conductive layer as a heating means for heat development and/or diffusion transfer of a dye. The transparent or opaque heating element to be used in such a configuration can be prepared as a resistance heating element by any suitable known technique.

Examples of such a resistance heating element include a thin film of an inorganic material having semiconductivity, and a thin film comprising electrically conductive particles dispersed in a binder. Materials used in these resistance heating elements include those described in Japanese Patent Application (OPI) No. 29835/86.

The dye fixing element according to the present invention may also comprise at least one dye fixing layer containing a mordant. If the dye fixing layer is disposed on the outer surface of the element, a protective layer may optionally be further provided thereon.

With regard to the layer configuration of the dye fixing element and the method of incorporation of and the positioning of the binder, additives and mordant, those described in Japanese Patent Application (OPI) No. 147244/86 may be applied to the present invention.

The dye fixing element of the present invention may optionally comprise auxiliary layers such as a peeling-off layer, a matting layer, and an anti-curling layer.

One or a plurality of the above layers may contain a base and/or base precursor and a hydrophilic heat solvent for accelerating the transfer of a dye, a discoloration inhibitor for inhibiting the discoloration of a dye, an ultraviolet absorber, a sliding agent, a matting agent, an oxidation inhibitor, a dispersed vinyl compound for increasing the dimensional stability of the material, a fluorescent brightening agent, or the like. Specific examples of these additives are described in Research Disclosure, No. 17029 (Vol. 170, June 1978) and U.S. Pat. No. 4,500,626.

The binder in the above layers is preferably hydrophilic. Typical examples of such a hydrophilic binder include transparent or semitransparent hydrophilic colloids. Specifically, the binders described with reference to the above light-sensitive material are preferred to be employed.

Examples of the dye fixing layer of the present invention include a dye fixing layer generally used in a heat-developable color light-sensitive material. Materials comprising the dye fixing layer can be properly selected from conventional mordants. Particularly preferred among these mordants is a polymer mordant. polymer mordants include a polymer containing a tertiary amino group, a polymer containing a nitrogen-containing heterocyclic portion, or a polymer containing a quarternary cation group of the above teertiary amino group and/or nitrogen-containing heterocyclic portion.

Specific examples of such a polymer mordant are described in Japanese Patent Application (OPI) No. 147244/86 and U.S. Pat. No. 4,500,626.

With regard to the process for coating a heat-developable light-sensitive layer, protective layer, intermediate layer, undercoat layer, backing layer, or other layers onto a support, the methods described in U.S. Pat. No. 4,500,626 can be applied to the present invention.

Light sources to which the heat-developable light-sensitive material is imagewise exposed so that an image is recorded thereon include radiation including visible light. Examples of suitable light sources are described in Japanese Patent (OPI) No. 147244/86 and U.S. Pat. No. 4,500,626.

With regard to pressure conditions and processes for applying pressure when the heat-developable light-sensitive element and the dye fixing element are superimposed on each other and thus brought into close contact with each other, those described in Japanese Patent Application (OPI) No. 147244/86 can be applied to the present invention.

The present invention will be further illustrated in the following example, but the present invention should not be construed as being limited thereto. Unless otherwise indicated, all parts, percents, ratios and the like are by weight.

EXAMPLE 1

Preparation of benzotriazole silver emulsion 28 g of gelatin and 13.2 g of benzotriazole were dissolved in 300 ml of water. The aqueous solution thus obtained was stirred while the temperature thereof was maintained at 40° C. An aqueous solution obtained by dissolving 17 g of silver nitrate in 100 ml of water was added to the above solution over a period of 2 minutes.

The pH of the benzotriazole silver emulsion was adjusted so that precipitation took place to remove excess salt. Thereafter, the pH of the emulsion was adjusted to 6.30. As a result, 400 g of a benzotriazole silver emulsion was obtained.

Preparation of silver halide emulsions for a 5th layer and a 1st layer 600 ml of an aqueous solution containing sodium chloride and potassium bromide and an aqueous solution of silver nitrate (a solution comprising 0.59 mole of silver nitrate in 600 ml of water) were added to an aqueous solution of gelatin (a solution comprising 20 g of gelatin and 3 g of sodium chloride in 1,000 ml of water, kept at a temperature of 75° C.) at the same flow rate over a period of 40 minutes while the latter was vigorously stirred. Thus, a monodispersed emulsion of cubic silver chlorobromide particles having an average particle size of 0.40 μm (bromide content: 50 mol %) was prepared.

The monodispersed silver chlorobromide emulsion obtained was then washed with water and desalted. 5 mg of sodium thiosulfate and 20 mg of 4-hydroxy-6-methyl-1,3,3a,7-tetrazaindene were added to the emulsion. Thus, the emulsion was chemically sensitized. As a result, 600 g of the emulsion thus sensitized was obtained.

Preparation of silver halide emulsion for a 3rd layer 600 ml of an aqueous solution containing sodium chloride and potassium bromide and an aqueous solution of silver nitrate (a solution comprising 0.59 mole of silver nitrate in 600 ml of water) were added to an aqueous solution of gelatin (a solution comprising 20 g of gelatin and 3 g of sodium chloride in 1,000 ml of water, kept at a temperature of 75° C.) ar the same flow rate over 40 minutes while vigorously stirred. Thus, a monodispersed emulsion of cubic silver chlorobromide particles having an average particle size of 0.35 μm (bromide content: 80 mol %) was prepared.

The silver chlorobromide emulsion obtained was then washed with water and desalted. 5 mg of sodium thiosulfate and 20 mg of 4-hydroxy-6-methyl-1,3,3a,7-tetrazaindene were added to the emulsion. Thus, the emulsion was chemically sensitized at a temperature of 60° C. As a result, 600 g of the emulsion thus sensitized was obtained.

Preparation of gelatin dispersions of dye providing substances 5 g of Yellow Dye Providing Substance (A) (chemical structures of this and other dye providing substances are shown hereinafter) and 0.5 g of 2-ethyl-hexyl succinate sodium sulfonate and 10 g of triisononylphosphate as surface active agents were weighed, and 30 ml of ethyl acetate was added thereto. The admixture was heated to a temperature of about 60° C. so that a uniform solution was obtained. The solution thus obtained and g of a 10% aqueous solution of lime-treated gelatin were mixed with stirring. The mixture was then subjected to dispersion at 10,000 rpm for 10 minutes by means of a homogenizer. This dispersion is referred to as Dispersion of Yellow Dye Providing Substance.

Dispersion of Magenta Dye Providing Substance was prepared in the same manner as used for Dispersion of Yellow Dye Providing Substance except that Magenta Dye Providing Substance (B) and 7.5 g of tricresyl phosphate as a high boiling point solvent were used.

Dispersion of Cyan Dye Providing Substance was prepared in the same manner as used for Dispersion of Yellow Dye Providing Substance except that Cyan Dye Providing Substance (C) was used.

As High Molecular WEight Compound P-1, SUMIKAGEL L-5(H) was used which is a copolymer of vinyl alcohol and acrylic acid (copolymerization ratio: about 6/4 by mole) in which the whole of the acrylic acid component is substantially saponified.

Using these emulsions and dispersions, Color Light-Sensitive Elements A and B having multilayer configurations as shown in Table 1 below were prepared. The coated amount of gelatin and High Molecular Weight Compound P-1 are shown in Table 2.

TABLE 1

| Layer Structures of Light-Sensitive Elements A and B | |
|---|---|
| 6th layer: | gelatin (amount shown in Table 2), High Molecular Weight Compound, P-1 (amount shown in Table 2), hardener (*3) (coated amount: 16 mg/m$^2$), silica(*5) (coated amount: 100 mg/m$^2$) |
| 5th layer: | green sensitive emulsion layer: silver chlorobromide emulsion (bromide content: 50 mol %, coated amount: 400 mg/m$^2$ calculated as silver) benzotriazole silver emulsion (coated amount: 100 mg/m$^2$ calculated as silver), Sensitizing Dye D-1 (coated amount: $10^{-6}$ mol/m$^2$), hardener (*3) (coated amount: 16 mg/m$^2$), Yellow Dye Providing Substance (A) (coated amount: 400 mg/m$^2$), gelatin (amount shown in Table 2), High Molecular Weight Compound P-1 (amount shown in Table 2), high boiling point solvent (*4) (coated amount: 800 mg/m$^2$), surface active agent (*2) (coated amount: 100 mg/m$^2$) |
| 4th layer: | intermediate layer: gelatin (amount shown in Table 2), High Molecular Weight Compound P-1 (amount shown in Table 2), hardener (*3) (coated amount: 18 mg/m$^2$) |
| 3rd layer: | red sensitive emulsion layer: silver chlorobromide emulsion (bromide content: 80 mol %, coated amount: 300 mg/m$^2$ calculated as silver), benzotriazole silver emulsion (coated amount: 100 mg/m$^2$ calculated as silver), Sensitizing Dye D-2 (coated amount $8 \times 10^{-7}$ mol/m$^2$), Magenta Dye Providing Substance (B) (coated amount: 400 mg/m$^2$), gelatin (amount shown in Table 2), High Molecular Weight Compound P-1 (amount shown in Table 2), high boiling point solvent (*1) (coated amount: 600 mg/m$^2$), surface active agent (*2) (coated amount: 100 mg/m$^2$) |
| 2nd layer: | intermediate layer: gelatin (amount shown in Table 2), High Molecular Weight Compound P-1 (amount shown in Table 2), hardener (*3) (coated amount: 16 mg/m$^2$) |
| 1st layer: | infrared sensitive emulsion layer: silver chlorobromide emulsion (bromide content: 50 mol %, coated amount: 300 mg/m$^2$ calculated as silver), benzotriazole silver emulsion (coated amount: 100 mg/m$^2$ calculated as silver), Sensitizing Dye D-3 (coated amount: $10^{-6}$ mol/m$^2$), hardener (*3) (coated amount: 16 mg/m$^2$), Cyan Dye Providing Substance (C) coated amount: 300 mg/m$^2$), gelatin (amount shown in Table 2), High Molecular Weight Compound P-1 (amount shown in Table 2), high boiling point solvent (*4) (coated amount: 600 mg/m$^2$), surface active agent (*2) (coated amount: 100 mg/m$^2$) |
| Support: | polyethylene terephthalate (thickness: 100 μm) |

(*1): tricresyl phosphate (*2): 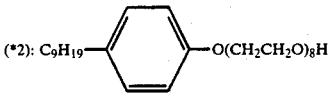

(*3): 1,2-bis(vinylsulfonylacetamide)ethane
(*4): (iso $C_9H_{19}O)_3P = 0$
(*5): particle size: 4 μm

TABLE 2

| | Light-Sensitive Element A (comparative) | | Light-Sensitive Element B (present invention) | |
|---|---|---|---|---|
| | Coated amount of gelatin (mg/m$^2$) | Coated amount of High Molecular Weight Compound P-1 (mg/m$^2$) | Coated amount of gelatin (mg/m$^2$) | Coated amount of High Molecular Weight Compound P-1 (mg/m$^2$) |
| 6th layer | 800 | 0 | 550 | 250 |
| 5th layer | 1000 | 0 | 1000 | 0 |
| 4th layer | 900 | 0 | 540 | 360 |
| 3rd layer | 1000 | 0 | 1000 | 0 |
| 2nd layer | 800 | 0 | 480 | 320 |
| 1st layer | 1000 | 0 | 1000 | 0 |

Dye Providing Substances
Dye Providing Substances
(A)
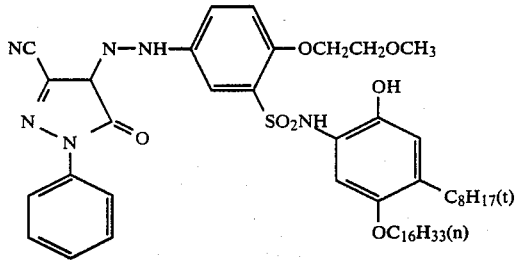
(B)
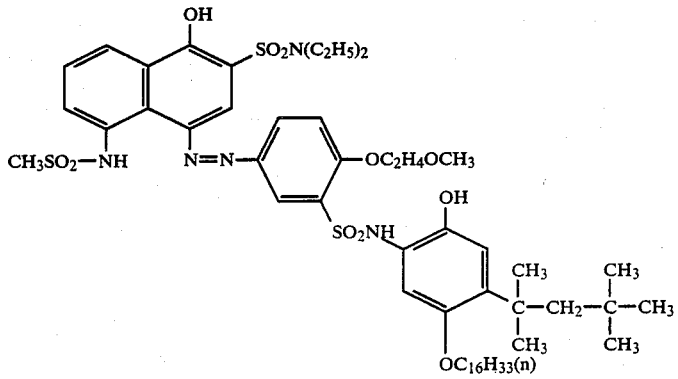
(C)
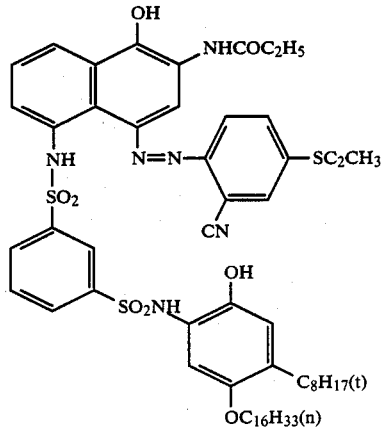
Sensitizing Dyes
(D-1)
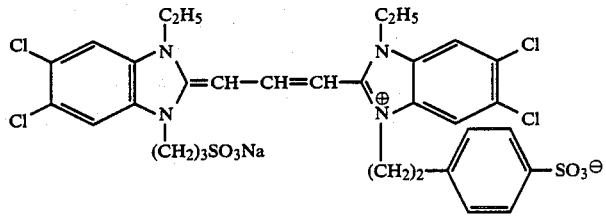
(D-2)
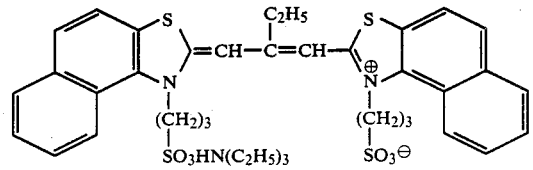

-continued

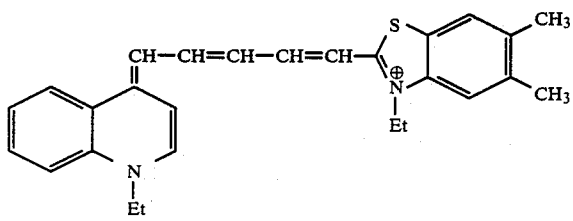

(D-3)

The swelling speed of these light-sensitive elements were measured by the process described in *Photographic Science and Engineering*, (Vol. 16 page 449, 1972). The relationship between the water absorption time, the amount of water absorption and the amount of water required for the maximum swelling were determined. The results are shown in Table 3.

TABLE 3

| Light-Sensitive Element | Amount of water required for maximum smelling ($g/m^2$) | Absorbed amount of water ($g/m^2$) Water absorption time 1 sec. | 2 sec. | 4 sec. |
|---|---|---|---|---|
| A (comparative) | 12 | 4.0 | 6.0 | 8.7 |
| B (present invention) | 15 | 9.0 | 12.0 | 14.7 |

As can be seen in Table 3, the use of High Molecular Weight Compound P-1 according to the present invention amount of water to be absorbed by the light-sensitive element in a short period of time as compared to the comparative material (A).

Preparation of dye fixing element 10 g of poly(methyl acrylate-co-N,N,N-trimethyl-N-vinylbenzyl ammonium chloride) (copolymerization ratio of methyl acrylate to vinylammonium chloride: 1/1) was dissolved in 200 ml of water. The aqueous solution thus obtained was uniformly mixed with 100 g of 10% lime-treated gelatin. The admixture was uniformly coated on a paper support laminated with a polyethylene having titanium dioxide dispersed therein in an amount such that the wet thickness of the layer reached 90 μm.

A solution obtained by mixing 6 g of guanidine carbonate, 16 ml of water, 20 g of 10% lime-treated gelatin, 4.8 ml of 1% aqueous solution of 2-thylhexyl succinate sodium sulfonate, and 2 ml of 2% aqueous solution of 2,4-dichloro-6-hydroxy-1,3,5-triazine was coated onto the above coated layer in an amount such that the wet thickness of the layer reached 30 μm. The coated layer was then dried for use as a dye fixing element containing a mordant.

The above-described multilayered color light-sensitive elements were exposed to a light of 500 lux from a tungsten lamp through a separation filter having a density gradation (G: 500–600 nm band pass filter; R: 600–700 nm band pass filter; IR: 700 nm or higher band pass filter) for 1 second.

Water was supplied to the emulsion side of the light-sensitive element thus exposed in an amount of 10 $ml/m^2$ by means of a wire bar. The time taken until the water completely permeated the coated layer of the light-sensitive element was measured. The light-sensitive element was then laminated with the dye fixing element so that the coated layers were brought into contact with each other. Thus laminated light-sensitive material was heated for 20 seconds by heat rollers which had been temperature-adjusted to keep the temperature of the wet layer at 90° to 95° C. The dye fixing element was then peeled off the light-sensitive element. As a result, sharp yellow, magenta and cyan images were obtained on the dye fixing element corresponding to G, R and IR separation filters, respectively. The maximum density ($D_{max}$) and the minimum density ($D_{min}$) of these colors were measured by Macbeth reflection densitometer (RD-519). The results are shown in Table 4.

The difference in the weight of the dye fixing material corresponding to when it was just peeled off and after being dried in a desiccator for 3 days was determined to measure the amount of water transferred to the dye fixing element. The results are shown in Table 4.

TABLE 4

| Light-Sensitive Element | | $D_{max}$ | $D_{min}$ | Uneven image | Time required for absorption of 10 $ml/m^2$ of water (sec.) | Amount of water transferred to dye fixing material ($g/m^2$) |
|---|---|---|---|---|---|---|
| A (comparative) | Y* | 1.8 | 0.10 | Not observed | approx. 6 | 5.0 |
| | M* | 2.5 | 0.12 | | | |
| | C* | 2.4 | 0.10 | | | |
| B (present invention) | Y | 1.8 | 0.10 | Not observed | approx. 1.1 | 2.5 |
| | M | 2.5 | 0.11 | | | |
| | C | 2.4 | 0.10 | | | |

*Y = yellow; M = magenta; C = cyan

Light-Sensitive Element A was processed in the same manner as described above except that the time required for absorption of water was shortened to that required for Light-Sensitive Element B (approx. 1.1 sec.). The resulting image had a large number of uneven portions.

EXAMPLE 2

Preparation of acetylene silver emulsion

A solution containing 17.7 g of 4-acetylaminophenylacetylene dissolved in 100 ml of methanol and a solution containing 28 g of gelation dissolved in 200 ml of water were mixed and the solution was maintained at 40° C. with stirring. A solution of 17 g of silver nitrate dissolved in 100 ml of water was added to the above prepared solution over 2 minutes. The thus prepared emulsion was adjusted in pH, precipitated and freed of excess salts. It was then adjusted to pH 6.3, whereby 400 g of a 4-acetylaminophenylacetylene silver emulsion was obtained.

As High Molecular Weight Compound P-1, SUMIKAGEL L-5(H) as described in Example 1 was used. High Molecular Weight Compound P-2 is mentioned hereinafter.

As the benzotriazole silver emulsion, the silver halide emulsions, and the gelatin dispersions cf dye providing substances, those used in Example 1 were employed.

By using these emulsions and dispersions, Color Light-Sensitive Elements C, D and E having multilayer configurations as shown in Table 5 below were prepared. The coated amount of gelatin and High Molecular Weight Compounds P-1 and P-2 are shown in Table 6.

TABLE 5

| Layer Structure of Light-Sensitive Elements C, D and E | |
|---|---|
| 7th layer: | gelation (amount shown in Table 6), High Molecular Weight Compound P-1 or P-2 (amount shown in Table 6), hardener (*3) (coated amount: 10 mg/m$^2$), silica (*5) (Coated amount: 100 mg/m$^2$) |
| 6th layer: | gelation (coated amount: 400 mg/m$^2$), hardener (*3) (coated amount: 10 mg/m$^2$), reducing agent (E) (coated amount: 200 mg/m$^2$) |
| 5th layer: | green sensitive emulsion layer: silver chlorobromide emulsion (bromide content: 50 mol %, coated amount: 400 mg/m$^2$ calculated as silver), acetylene silver emulsion (coated amount: 100 mg/m$^2$ calculated as silver), Sensitizing Dye D-1 (coated amount: $10^{-6}$ mol/m$^2$), hardener (*3) (coated amount: 16 mg/m$^2$), Yellow Dye Providing Substance (A) (coated amount: 400 mg/m$^2$), gelatin (coated amount: 1,000 mg/m$^2$), high boiling point solvent (*4) (coated amount: 200 mg/m$^2$), surface active agent (*2) (coated amount: 100 mg/m$^2$) |
| 4th layer: | intermediate layer: gelatin (amount shown in Table 6), High Molecular Weight Compound P-2 (amount shown in Table 6), hardener (*3) (coated amount: 18 mg/m$^2$), zinc hydroxide (*6) (coated amount: 500 mg/m$^2$) |
| 3rd layer: | red sensitive emulsion layer: silver chlorobromide emulsion (bromide content: 80 mol %, coated amount: 300 mg/m$^2$ calculated as silver), acetylene silver emulsion (coated amount: 100 mg/m$^2$ calculated as silver), Sensitizing Dye D-2 (coated amount: $8 \times 10^{-7}$ mol/m$^2$), hardener (*3) (coated amount: 18 mg/m$^2$), Magenta Dye Providing Substance (B) (coated amount: 400 mg/m$^2$), gelatin (coated amount: 1,000 mg/m$^2$), high boiling point solvent (*1) (coated amount: 200 mg/m$^2$), surface active agent (*2) (coated amount: 100 mg/m$^2$) |
| 2nd layer: | intermediate layer: gelation (amount shown in Table 6), High Molecular Weight Compound P-2 (amount shown in Table 6), hardener (*3) (coated amount: 16 mg/m$^2$), zinc hydroxide (*6) (coated amount: 500 mg/m$^2$) |
| 1st layer: | red sensitive emulsion layer silver chlorobromide emulsion (bromide content: 50 mol %, coated amount: 300 mg/m$^2$ calculated as silver), benzotriazole silver emulsion (coated amount: 100 mg/m$^2$ calculated as silver), Sensitizing Dye D-3 (coated amount: $10^{-8}$ mol/m$^2$), Cyan Dye Providing Substance (C) (coated amount: 300 mg/m$^2$), gelatin (coated amount: 1,000 mg/m$^2$), high boiling point solvent (*4) (coated amount: 150 mg/m$^2$), surface active agent (*2) (coated amount: 100 mg/m$^2$) |
| Support: | polyethylene terephthalate (thickness: 100 μm) |

(*1): tricresyl phosphate (*2): $C_9H_{19}$— 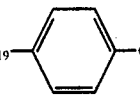 —$O(CH_2CH_2O)_8H$ (*3): 1,2-bis (vinylsulfoinylacetamide) ethane
(*4): (iso $C_9H_{19}O)_3P = O$
(*5): particle size: 3 to 5 μm
(*6): particle size: 0.2 to 0.3 μm High Molecular Weight Compound P-2

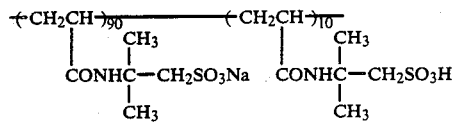

Reducing Agent (E)

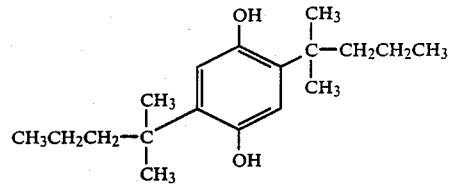

TABLE 6

| | Light-Sensitive Element C (comparative) | | Light-Sensitive Element D (present invention) | |
|---|---|---|---|---|
| | Coated amount of gelatin (mg/m$^2$) | Coated amount of High Molecular Weight Compound P-1 (mg/m$^2$) | Coated amount of gelatin (mg/m$^2$) | Coated amount of High Molecular Weight Compound P-1 (mg/m$^2$) |
| 7th layer | 800 | 0 | 550 | 250 |
| 4th layer | 700 | 0 | 700 | 0 |
| 2nd layer | 800 | 0 | 800 | 0 |

| | Light-Sensitive Element E (present invention) | |
|---|---|---|
| | Coated amount of gelatin | Coated amount of High Molecular Weight Compound P-2 |

TABLE 6-continued

| | | |
|---|---|---|
| 7th layer | 550 | 250 |
| 4th layer | 560 | 140 |
| 2nd layer | 640 | 160 |

The swelling speed of these light-sensitive elements were measured in the same manner as in Example 1. The results are shown in Table 7.

TABLE 7

| required for Light-Sensitive Element | Amount of water ($g/m^2$) maximum smelling ($g/m^2$) | Absorbed amount of water Water absorption time 1 sec. | 2 sec. | 4 sec. |
|---|---|---|---|---|
| C (comparative) | 12.5 | 4.0 | 6.0 | 8.8 |
| D (present invention) | 15.5 | 9.0 | 12.2 | 15.1 |
| E (present invention) | 18.0 | 10.0 | 14.0 | 17.0 |

As can be seen in Table 7, the use of the high molecular weight compound according to the present invention enables the supply of a large amount of water to be absorbed by the light-sensitive element in a short period of time.

Preparation of dye fixing element 63 g of gelatin and 130 g of a mordant having the following formula were dissolved in 1,300 ml of water.

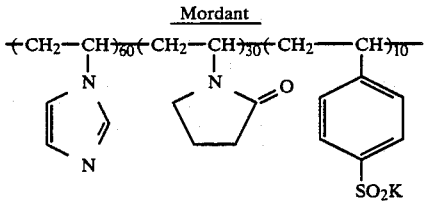

A solution obtained by mixing 35 g of gelatin, 4.0 g of 1,2-bis(vinylsulfonylacetamide)ethane, and 135 g of guanidine picolinate with 800 ml of water was coated onto the above coated layer in an amount such that the wet thickness of the layer reached 17 μm, to form a protective layer.

The Light-Sensitive Elements C and D were exposed to a light of 500 lux from a tungsten lamp through a separation filter having a density gradation (G: 500–600 mm band pass filter: R: 600–700 nm band pass filter; IR: 700 nm or higher band pass filter) for 1 second.

Water was supplied to the emulsion side of the light-sensitive element thus exposed in an amount of 10 $ml/m^2$ by means of a wire bar. The time taken until the water completely permeated the coated layer of the light-sensitive element was measured. The light-sensitive element was then laminated with the dye fixing element so that the coated layers were brought into contact with each other. Thus laminated light-sensitive material was heated for 20 seconds by heat rollers which had been temperature-adjusted to keep the temperature of the wet layer at 95° C. The dye fixing element was then peeled off the light-sensitive element. As a result, sharp yellow, magenta and cyan images were obtained on the dye fixing element corresponding to G, R and IR separation filters, respectively. The maximum density (Dmax) and the minimum density (Dmin) of these colors were measured by Macbeth reflection densitometer (RD-519). The results are shown in Table 8.

The difference in the weight of the dye fixing material corresponding to when it was just peeled off and after being dried in a desiccator for 3 days was determined to measure the amount of water transferred to the dye fixing element. The results are shown in Table 8.

TABLE 8

| Light-Sensitive Element | | | $D_{max}$ | $D_{min}$ | Uneven image | Time required for absorption of 10 $ml/m^2$ of water (sec.) | Amount of water transferred to dye fixing material ($g/m^2$) |
|---|---|---|---|---|---|---|---|
| C | (comparative) | Y* | 1.8 | 0.12 | Not observed | approx. 6 | 4.5 |
| | | M* | 2.5 | 0.12 | | | |
| | | C* | 2.4 | 0.10 | | | |
| D | (present invention) | Y | 1.8 | 0.12 | Not observed | approx. 1.1 | 2.0 |
| | | M | 2.5 | 0.12 | | | |
| | | C | 2.4 | 0.09 | | | |

*Y = yellow; M = magenta; C = cyan

The aqueous solution obtained was uniformly coated on a paper support laminated with a polyethylene in an amount such that the wet thickness of the layer reached 42 μm.

Light-Sensitive Element C was processed in the same manner as described above except that the time required for absorption of water was shortened to that required for Light-Sensitive Element D (approx. 1.1 sec.). The resulting image had a large number cf uneven portions.

The above results show that the use of the high molecular weight compound of the present invention makes it possible to provide a uniform image having an excellent discrimination and requiring a short period of time for water absorption. Furthermore, the use of the high molecular weight compound of the present invention shortens the time required to allow the light-sensitive material to absorb the necessary amount of water. The presence of this compound also lowers the amount of water to be transferred to the dye fixing element, thus makes easy to dry the dye fixing element. Therefore, the total processing time can be shortened.

In accordance with the process for forming an image of the present invention, when a heat-developable light-sensitive material is heated in the presence of water and a base and/or base precursor after or simultaneously with imagewise exposure to light, an image having a sufficient density can be easily obtained in a short processing time without giving unevenness in development. This is due to the fact that the light sensitive material contains the high molecular weight compound of the present invention.

While the invention has been described in detail and with reference to specific embodiments thereof, it will be apparent to one skilled in the art that various changes and modifications can be made therein without departing from the spirit and scope thereof.

What is claimed is:

1. A process for forming an image comprising heating a heat-developable light-sensitive material comprising a support having thereon at least a light-sensitive silver halide and a high molecular weight compound having an average molecular weight of from $1\times10^4$ to $2\times10^6$ containing a repeating unit derived from a vinyl monomer having at least one of a group —COOM and a group —$SO_3M$ wherein M represents a hydrogen atom or an alkali metal atom, simultaneously with or after imagewise thereof, in the presence of water externally supplied in an amount between 0.1 times the weight of the entire coated layer and the weight of water corresponding to the maximum swelling volume of the entire coating layer, and at least one of a base and a base precursor.

2. A process for forming an image as in claim 1, wherein said high molecular weight compound contains a repeating unit represented by formula (I)

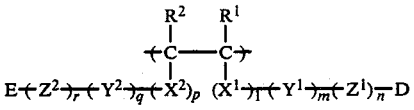

(I)

wherein $R^1$ represents a hydrogen atom, a substituted or unsubstituted alkyl group having from 1 to 6 carbon atoms, a chlorine atom, or a group —COOM wherein M represents a hydrogen atom or an alkali metal atom; $R^2$ represents a hydrogen atom, a substituted or unsubstituted alkyl group having from 1 to 6 carbon atoms, or a chlorine atom; $X^1$ and $X^2$ each represent a group

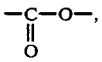

a group

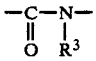

(wherein $R^3$ represents a hydrogen atom, a substituted or unsubstituted alkyl group, or a substituted or unsubstituted aryl group), or a substituted or unsubstituted phenylene group; $Y^1$, $Y^2$, $Z^1$ and $Z^2$ each represent a linking group having a valence of 2; D represents $\text{-}(R^{11})_a\text{COOM}$ or $\text{-}(R^{11})_b\text{SO}_3\text{M}$; E represents a hydrogen atom, $\text{-}(R^{11})_a\text{COOM}$ or $\text{-}(R^{11})_b\text{SO}_3\text{M}$ (wherein M represents a hydrogen atom or an alkali metal atom, $R^{11}$ represents a substituted or unsubstituted alkylene group, a substituted or unsubstituted phenylene group, or a substituted or unsubstituted aralkylene group, and a and b each represent 0 or 1); l, m, p and q each represent 0 or 1; and n and r each represent an integer of from 0 to 30.

3. A process for forming an image as in claim 2, wherein $Y^1$, $Y^2$, $Z^1$ and $Z^2$ in formula (I) each represent a substituted or unsubstituted alkylene group, a substituted or unsubstituted aralkylene group, a substituted or unsubstituted phenylene group, —$R^4$COO—, —$R^5$OCO—, —$R^6$OCO$R^7$—COO—,

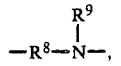

or —$R^{10}$—O—, wherein $R^4$, $R^5$, $R^6$, $R^7$, $R^8$, $R^9$ and $R^{10}$ each represent a substituted or unsubstituted alkylene group, a substituted or unsubstituted phenylene group, or a substituted or unsubstituted aralkylene group.

4. A process for forming an image as in claim 3, wherein said high molecular weight compound contains a repeating unit represented by formula (II)

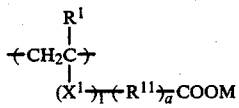

(II)

wherein $R^1$, $X^1$, $R^{11}$, M, 1 and a each represent the same meanings as in claim 3.

5. A process for forming an image as in claim 3, wherein said high molecular weight compound contains a repeating unit represented by formula (III)

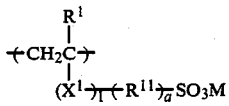

(III)

wherein $R^1$, $X^1$, $R^{11}$, M, 1 and a each represent the same meanings as in claim 3.

6. A process for forming an image as in claim 1, wherein said high molecular weight compound comprises a saponified product of a copolymer comprising a vinyl ester and an ethylenic unsaturated carboxylic acid or a derivative thereof.

7. A process for forming an image as in claim 1, wherein said high molecular weight compound comprises a hydrolyzate of a polymer comprising acrylonitrile.

8. A process for forming an image as in claim 6, wherein the molar ratio of said vinyl ester to said ethylenic unsaturated crboxylic acid or a derivative thereof is about from 0:100 to about 80:20.

9. A process for forming an image as in claim 7, wherein said polymer comprising acrylonitrile contains 30 wt % or more of acrylonitrile based on the total amount of said polymer.

10. A process for forming an image as in claim 1, wherein said high molecular weight compound has the content of said repeating unit derived from a vinyl monomer having at least one of a group —COOM and a group —$SO_3M$ of from 1 to 99.5 mol %.

11. A process for forming an image as in claim 10, wherein said high molecular weight compound has the content of said repeating unit derived from a vinyl monomer having at least one of a group —COOM and a group —$SO_3M$ of from 20 to 99 mol %.

12. A process for forming an image as in claim 1, wherein said high molecular weight compound has a degree of swelling of 5 or more with respect to water.

13. A process for forming an image as in claim 12, wherein said high molecular weight compound has a degre of swelling of 10 or more with respect to water.

14. A process for forming an image as in claim 1, wherein said high molecular weight compound is present in an amount of from about 0.05 to about 20 g based on 1 $m^2$ of said support.

15. A process for forming an image as in claim 14, wherein said high molecular weight compound is present in an amount of from about 0.1 to about 5 g based on 1 $m^2$ of said support.

16. A process for forming an image as in claim 1, wherein said heat-developable light-sensitive material comprises a light-sensitive element and a dye fixing element.

* * * * *